US011806557B2

(12) United States Patent
Alleyne

(10) Patent No.: US 11,806,557 B2
(45) Date of Patent: Nov. 7, 2023

(54) PROTECTIVE GARMENT HAVING IMPROVED HOOD ELASTOMERIC INTERFACE

(71) Applicant: DUPONT SAFETY & CONSTRUCTION, Inc., Wilmington, DE (US)

(72) Inventor: Roberta Espinoza Alleyne, Bethune, SC (US)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 486 days.

(21) Appl. No.: 16/593,383

(22) Filed: Oct. 4, 2019

(65) Prior Publication Data

US 2020/0179732 A1 Jun. 11, 2020

Related U.S. Application Data

(60) Provisional application No. 62/776,192, filed on Dec. 6, 2018.

(51) Int. Cl.

| | |
|---|---|
| ***A62B 17/04*** | (2006.01) |
| ***A62B 17/00*** | (2006.01) |
| ***A62B 18/08*** | (2006.01) |

(52) U.S. Cl.

CPC ..... *A62B 17/04* (2013.01); *A62B 17/006* (2013.01); *A62B 18/084* (2013.01)

(58) Field of Classification Search

CPC ..... A62B 17/006; A62B 17/94; A62B 17/003; A62B 17/04; A62B 18/084; A62B 18/08; B63C 11/04; B63C 11/14; B63C 2011/046; B63C 2011/043; A41D 13/1153; A42B 1/046

(Continued)

(56) References Cited

U.S. PATENT DOCUMENTS

| | | | |
|---|---|---|---|
| 4,214,321 | A | 7/1980 | Nuwayser |
| 4,272,851 | A | 6/1981 | Goldstein |

(Continued)

FOREIGN PATENT DOCUMENTS

| | | | |
|---|---|---|---|
| AU | 2015246298 | | 10/2015 |
| CN | 1988936 | A | 6/2007 |

(Continued)

OTHER PUBLICATIONS

PCT International Search Report, dated Feb. 18, 2020, for international application PCT/US2019/062155, filed Nov. 19, 2019; Adam Koszewski, authorized officer.

*Primary Examiner* — Patrick J. Lynch

(57) ABSTRACT

A protective garment comprising a hood with a face area, the face area provided with an elastomeric interface having an opening for engaging and demountably sealing a full-face mask or full-face respirator to the hood, the opening having a forehead edge and the chin edge that are both incurvate edges with respect to the center of the opening, and two cheek edges that are excurvate edges with respect to the center of the opening; the opening further having a centerline horizontal dimension between the first and second cheek edges and a centerline vertical dimension between the forehead edge and the chin edge; the centerline horizontal dimension to centerline vertical dimension aspect ratio being 1.5 or greater.

12 Claims, 4 Drawing Sheets

(58) Field of Classification Search
USPC ..... 441/105
See application file for complete search history.

(56) References Cited

U.S. PATENT DOCUMENTS

| | | | | |
|---|---|---|---|---|
| 4,772,510 | A | 9/1988 | McClure | |
| 4,833,010 | A | 5/1989 | Langley | |
| 4,855,178 | A | 8/1989 | Langley | |
| 4,920,575 | A | 5/1990 | Bartasis et al. | |
| 5,035,941 | A | 7/1991 | Blackburn | |
| 5,162,148 | A | 11/1992 | Boye et al. | |
| 5,626,947 | A | 5/1997 | Hauer et al. | |
| 5,653,225 | A * | 8/1997 | Schegerin | A62B 17/04 128/201.22 |
| 5,809,572 | A * | 9/1998 | Sisolak | A42B 1/046 2/173 |
| 6,032,285 | A * | 3/2000 | Densen | A41D 13/02 2/456 |
| 6,397,395 | B1 * | 6/2002 | DeHart | A41D 3/005 2/173 |
| 6,626,178 | B2 * | 9/2003 | Morgan | A62B 18/08 128/201.27 |
| 6,895,960 | B2 * | 5/2005 | Fabin | A62B 17/04 128/201.12 |
| 7,631,364 | B2 | 12/2009 | Culler | |
| 9,155,922 | B2 | 10/2015 | Samaniego | |
| 2002/0069449 | A1 * | 6/2002 | Blutstein | A42B 1/046 2/202 |
| 2005/0177924 | A1 * | 8/2005 | Colletti | A41D 13/11 2/206 |
| 2006/0102177 | A1 * | 5/2006 | Lewis | A62B 18/08 128/201.23 |
| 2014/0190476 | A1 * | 7/2014 | Stinton | A41D 13/1153 128/201.23 |
| 2016/0001111 | A1 | 1/2016 | Morgan et al. | |
| 2016/0193485 | A1 * | 7/2016 | Izz | A62B 18/04 128/201.25 |
| 2018/0304106 | A1 * | 10/2018 | O'Leary | A62B 17/006 |
| 2021/0307416 | A1 * | 10/2021 | Lessey, Sr. | A41D 13/1153 |

FOREIGN PATENT DOCUMENTS

| | | | |
|---|---|---|---|
| CN | 204540879 | U | 8/2015 |
| CN | 105142734 | A | 10/2015 |
| CN | 204722286 | U | 10/2015 |
| CN | 105658285 | A | 6/2016 |
| CN | 107259664 | A | 10/2017 |
| EP | 3205375 | A1 | 8/2017 |
| WO | 2005115550 | A1 | 10/2015 |

* cited by examiner

PROTECTIVE GARMENT HAVING IMPROVED HOOD ELASTOMERIC INTERFACE

BACKGROUND OF THE INVENTION

Field of the Invention

This invention relates to a protective garment suitable for use with a separate full-face mask or full-face respirator. The garment has a hood having a gasketed face opening for engaging and demountably sealing a respirator to the hood. Further, the protective garment can be removed while the wearer is still wearing the full-face mask or full-face respirator. As used herein, the phrases "gasketed face opening", "face area provided with an elastomeric gasket", "rubber-type cuff in the face area of the hood", and "face gasket" are all understood to be used interchangeably and refer to an "elastomeric interface" for the hood of the garment as designated by NFPA 1994.

Description of Related Art

In the field of chemical and/or biological protective clothing, garments having an integral clear face shield or lens; that is, a face shield of lens that is actually built and sealed into hood of the garment, are known. The design of these garments assures the wearer that the face area of the hood will be sealed during use. However, there are many different chemical and/or biological threats and situations, including those that require special masks and/or respirators. Therefore, hooded chemical and/or biological protective clothing has been developed that includes a with a rubber-type cuff in the face area of the hood that is designed to engage with a full-face mask or full-face respirator and provide some sealing. For example, a protective garment having a circular or oval opening for engaging a facemask such as DuPont Tychem® Styles BR611 and TF611T are known. Likewise, protective garments sold under the trademarks of DuPont Tychem® style TF611, TB-Safety Case One® B, and Microchem® 4000 151 have a face elastomeric interface having a tri-oval opening for engaging a facemask.

However, it has been found that improved hood sealing is desired when using certain full-face mask or full-face respirators. Specifically, it has been found that maintaining a good seal between the rubber hood gasket, that is, elastomeric interface, and the full-face mask or full-face respirators can be difficult in the forehead area and the chin area during use. In particular, there is a concern that in some instances the rubber hood gasket can slip off the full-face mask or full-face respirator if the wearer aggressively moves the head up or down, or after repetitive up-and-down head motions. What is needed is an improved hood sealing elastomeric interface that better interacts with the contours of a full-face mask or full-face respirator.

BRIEF SUMMARY OF THE INVENTION

This invention relates to a protective garment comprising a hood with a face area for covering the face of the wearer of the hood, the face area provided with an elastomeric interface, the elastomeric interface having an opening for engaging and demountably sealing a full-face mask or full-face respirator to the hood, the opening having a forehead edge, a chin edge, and first and second cheek edges, the forehead edge and the chin edge being incurvate edges with respect to the center of the opening, and the two cheek edges being excurvate edges with respect to the center of the opening; the opening further having a centerline horizontal dimension between the first and second cheek edges and a centerline vertical dimension between the forehead edge and the chin edge, the centerline horizontal dimension being longer than the centerline vertical dimension; the centerline horizontal dimension to centerline vertical dimension aspect ratio being 1.5 or greater.

DETAILED DESCRIPTION OF THE INVENTION

The protective garment comprises a hood having a face area provided with an elastomeric interface having an opening for engaging and demountably sealing a full-face mask or full-face respirator to the hood.

The protective garment with hood preferably comprises a protective apparel fabric. The term "protective apparel fabric" is meant to include a wide variety of protective garment fabrics, barrier fabrics, laminates, and films. The term "protective apparel fabric" also includes nonwoven and/or woven fabrics and laminates of such materials with films or multilayer films. In some embodiments, the outer hood protective fabric comprises a chemically-resistant outer layer. In some preferred embodiments the protective apparel fabric, and therefore the apparel material, is a multilayerfilm-and-nonwoven laminate. In some embodiments, the garment material is a nonwoven that resists penetration by liquids and/or particulates, such as a nonwoven like Tyvek® spunbonded polyethylene. Other useful protective apparel fabrics protect against a wide variety of threats and include but are not limited to those disclosed in, for example, U.S. Pat. No. 5,626,947 (Hauer et al.); U.S. Pat. No. 4,855,178 (Langley); U.S. Pat. No. 4,272,851 (Goldstein); U.S. Pat. No. 4,772,510 (McClure); U.S. Pat. No. 5,035,941 (Blackburn); U.S. Pat. No. 4,214,321 (Nuwayser); U.S. Pat. No. 4,920,575 (Bartasis); U.S. Pat. No. 5,162,148 (Boye); U.S. Pat. No. 4,833,010 (Langley).

In some embodiments, the protective garment is a hood. In some embodiments, the protective garment is a hooded coverall or a jacket with a hood. In some other embodiments, the protective garment is an encapsulating full-body chemical-resistant suit. In some preferred embodiments, the protective garment is a Level A, B, C or D protective garment. Level A garments are used in situations that require the highest level of skin, respiratory, and eye protection, and are generally totally encapsulating vapor protective garments. Level B garments are used in situations that require the highest level of respiratory protection but a lesser level of skin protection is needed. Level C garments are used in situations where atmospheric contaminants, liquid splashes, and other direct contact will not adversely affect or be absorbed by any exposed skin. Level D garments are used in situations where contamination is only a nuisance. There may be some instances where combinations of protective apparel rated for A, B, C, or D level may be used together.

Figure 1:
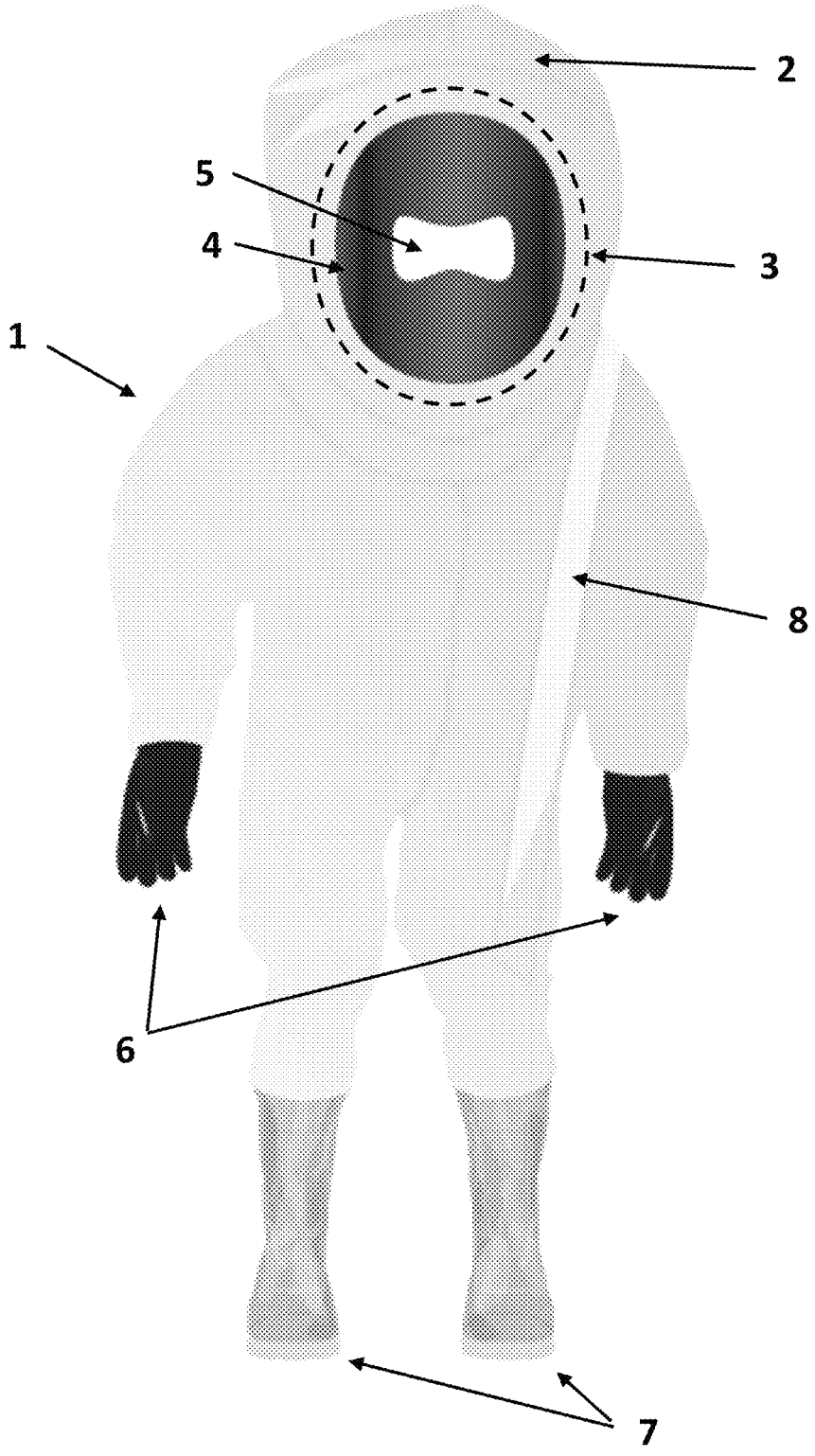
FIG. 1 is an illustration of the front of one type of protective garment, specifically an encapsulating full-body chemical-resistant suit, having a hood with a face area provided with an elastomeric interface having an opening for engaging and demountably sealing a full-face mask or full-face respirator to the hood. The figure is shown before the elastomeric interface engages the full-face mask or full-face respirator, that is, how the suit would look if the wearer was not also wearing a full-face mask or full-face respirator.
Figure 2:
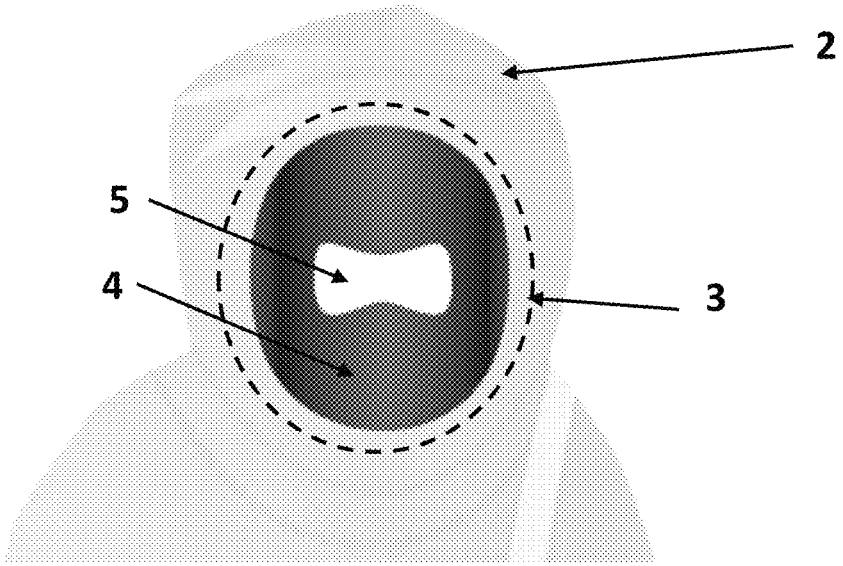
FIG. 2 is a detailed illustration of the hood of the encapsulating full-body chemical-resistant suit of FIG. 1, shown before the elastomeric interface engages with the full-face respirator.

FIG. 1 illustrates a protective garment in the form of an encapsulating full-body chemical-resistant suit 1 prior to donning a full-face mask or full-face respirator, and FIG. 2 is a detailed illustration of the hood of that suit. The protective garment comprises a hood 2 with a face area 3, as shown by the dashed line, provided with an elastomeric interface 4 having an opening 5 for engaging and demountably sealing a respirator to the hood. This suit is further shown with optional gloves 6 and boots 7, and flap 8 covering the entry point for the garment.

Figure 3:
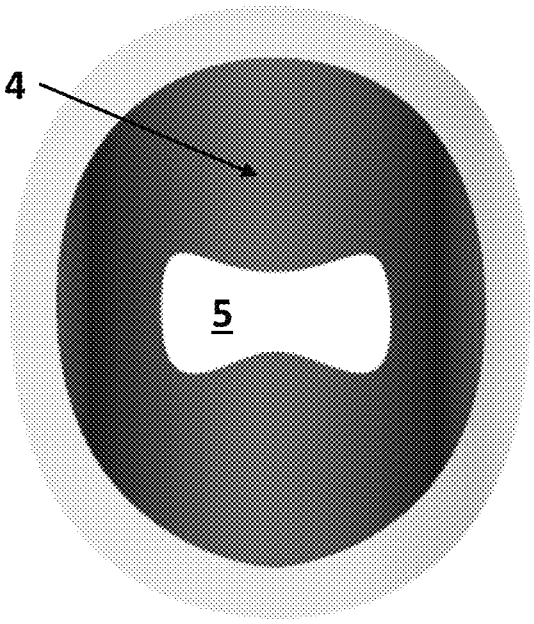
FIGS. 3 & 4 are front and side views, respectively, of the elastomeric interface having an opening.
Figure 4:
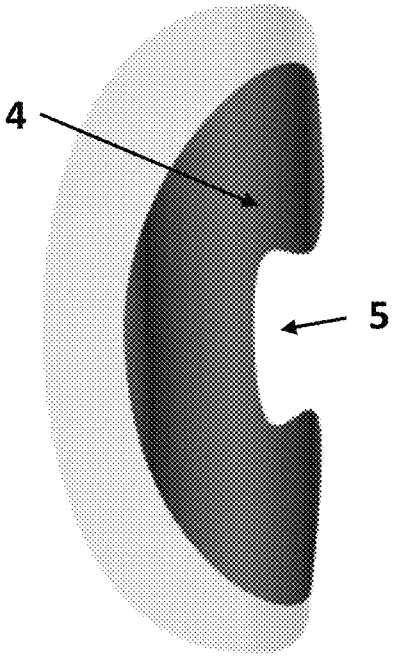

FIGS. 3 & 4 are front and side views, respectively, of the face area having an elastomeric interface 4 having an opening 5. As used herein "face area" is the area in the hood is the front part of the hood that would frame the face of at wearer.

The elastomeric interface is made from an elastomeric material, and as used herein, "elastomeric material" is meant to include any material that has stretch and recovery. In some preferred embodiments, such materials include artificial or natural rubber. In some embodiments useful elastomeric materials include those having the following nomenclature from ASTM Standard D1418-06 "Standard Practice for Rubber and Rubber Latices" of: EPDM (terpolymer of ethylene, propylene, and a diene with the residual unsaturated portion of the diene in the side chain); IR (synthetic isoprene); BIIR (bromo-isobutene-isoprene); BR (butadiene); CIIR (chloro-isobutene-isoprene); CR (chloroprene); CSM (chloro-sulfonyl-polyethylene); ECO (ethylene oxide (oxirane) and chloromethyl oxirane (epichlorohydrin copolymer)); EPM (copolymers of ethylene and propylene), FKM (fluoro rubber of the polymethylene type that utilizes vinylidene fluoride as a comonomer and has substituent fluoro, alkyl, perfluoroalkyl or perfluoroalkoxy groups on the polymer chain, with or without a cure site monomer (having a reactive pendant group)); FVMQ (silicone rubber having fluorine, vinyl, and methyl substituent groups on the polymer chain); HNBR (hydrogenated acrylonitrile-butadiene); IIR (isobutene-isoprene), VMQ (silicone rubber having both methyl and vinyl substituent groups on the polymer chain); NBR (acrylonitrile-butadiene); PU (polyurethane), SBR (styrene-butadiene); SEBS (poly[styrene-(block)-ethene-co-butane-(block)-styrene]), SIR (styrene-isoprene rubbers); XNBR (carboxylic-acrylonitrile-butadiene). Other useful materials have the common names of neoprene rubber, butyl rubber, tree rubber, and gum rubber. Other useful materials are known under the trademarks of Viton®, Buna S®, Hypalon®, Silastic®, Kalrez®, Chemraz®, Technoflon®, and others. In some embodiments, the elastomeric material has a useful shelf life that at least equals and preferably exceeds the shelf life of the protective apparel fabric used in the garment, which is typically at least 10 years based on current ASTM standards.

Figure 5:
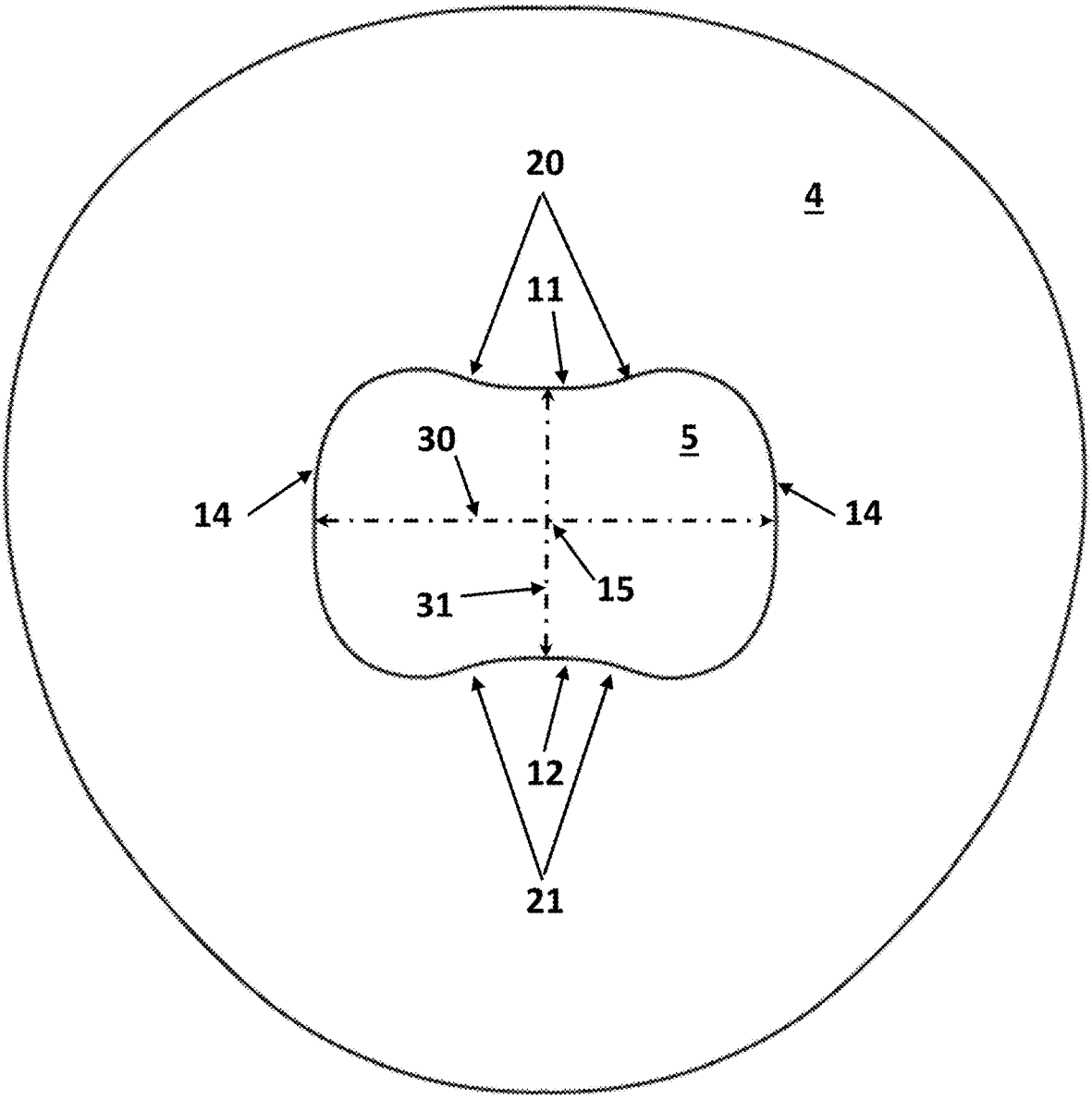
FIG. 5 is a detailed illustration of certain structural features of the elastomeric interface having an opening.

FIG. 5 is a detailed illustration of certain structural features of an elastomeric interface 4 having a stretchable opening 5. By "stretchable" it is meant that the elastomeric interface will stretch when it is engaged or pulled over the mounting for the lens or shield of a full-face mask or full-face respirator. The opening has a forehead edge 11, a chin edge 12, and first and second cheek edges 14. When the elastomeric interface is engaged with the full-face mask or full-face respirator, these stretchable edges—forehead edge, chin edge, and first and second cheek edges—all stretch and conform to the contour of a contact region around the periphery of the facepiece. Both the forehead edge 11 and the chin edge 12 are incurvate edges with respect to the center 15 of the opening. As used herein, "incurvate edge" has the typical definition of an edge that curves inward towards the center of the opening 15. The two cheek edges 14 are excurvate edges with respect to the center of the opening. As used herein, "excurvate edge" has the typical definition of an edge that curves outward or away from the center of the opening 15. It is understood that the forehead edge is located at the top of the opening, and when engaged with the full-face mask or full-face respirator, is positioned over the general forehead area of the wearer. Likewise, it is understood that the chin edge is located at the bottom of the opening, and when engaged with the full-face respirator is positioned over the general chin area of the wearer. Further, it is understood that each of the cheek edges is located at both sides of the opening, and when engaged with the full-face mask or full-face respirator, is positioned over the general cheek to ear area on either side of the head.

As shown in FIG. 5, prior to engaging the full-face mask or full-face respirator, the forehead edge, chin edge, and first and second cheek edges preferably trace a smooth curve around the opening, with the forehead edge/cheek edge boundary on either side of the face being the inflection points 20 where the excurvate edge of the cheek edge becomes the incurvate edge of the forehead edge. Likewise, the chin edge/cheek edge boundary on either side of the face being the inflection point 21 where the excurvate edge of the cheek edge becomes the incurvate edge of the forehead edge. This forms an opening wherein the forehead edge and the chin edge smoothly curve and extend into the opening, forming rounded tabs or "lips" in the opening, and forming a narrower neck separating two horizontally-oriented rounded lobes. Therefore, the opening takes the appearance similar to that of an hourglass shape laid on its side. This shape has also been referred to as a "dogbone" shape, but as illustrated in the figures, the dogbone has a single rounded lobe at each end.

As further shown on FIG. 5, the opening further has a centerline horizontal dimension, as shown by dashed line 30 between the first and second cheek edges, and a centerline vertical dimension, as shown by dashed line 31 between the forehead edge and the chin edge. In some embodiments, the centerline vertical dimension of the unstretched opening is 2 to 4 inches, preferably 2.2 to 3.5 inches. In some embodiments, the centerline horizontal dimension of the unstretched opening is 5 to 6.5 inches, preferably 5.5 to 6.0 inches.

By definition, both the centerline horizontal dimension 30 and the centerline vertical dimension 31 meet at the center of the opening 15. As shown in FIG. 5, the dashed line 31 also forms a centerline vertical axis of symmetry for the opening, with each of the two rounded lobes forming the first and second cheek edges being symmetrical about that axis. Further, prior to engaging the hood with the full-face respirator, the centerline horizontal dimension is longer than the centerline vertical dimension, the centerline horizontal dimension to centerline vertical dimension aspect ratio being 1.5 or greater. In some preferred embodiments, the aspect ratio is 1.7 or greater. It is believed that for best performance, a maximum aspect ratio of 3 or less is desired, as it has been found the elastomer interface may roll at larger aspect ratios. As evident in FIG. 5, the centerline vertical dimension 31 is also the minimum vertical dimension of the opening, the vertical dimension in the center of two symmetrical rounded lobes forming the first and second cheek edges being larger than that at the center of the opening 15. In some embodiments, the dashed line 30 also forms a centerline horizontal axis of symmetry for the opening.

FIG. 4 is a side view of a hood with a face area provided with an elastomeric interface, illustrating how the elastomeric interface engages with a full-face mask or full-face respirator and demountably seals the respirator to the hood.

Figure 6:
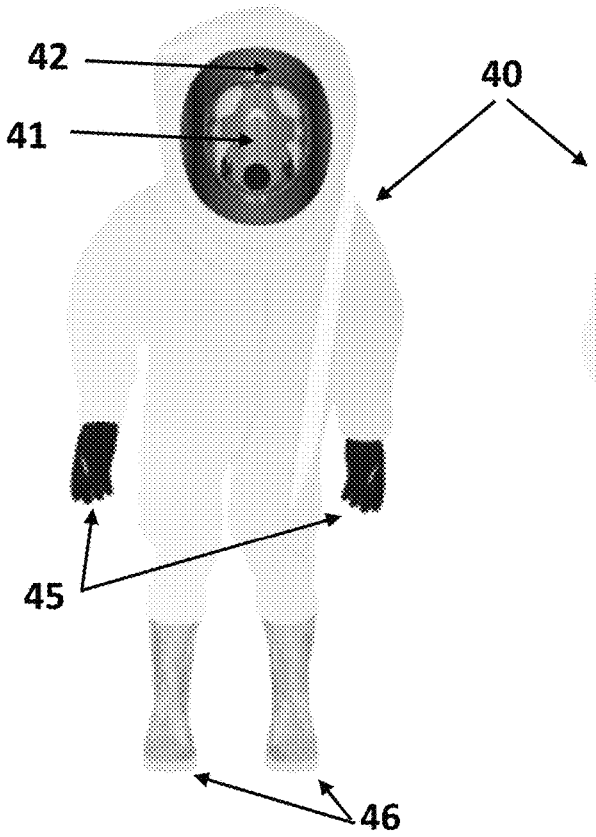
FIGS. 6 & 7 are illustrations of the front view and side view, respectively, of one type of protective garment, specifically an encapsulating full-body chemical-resistant suit, comprising a hood with a face area provided with an elastomeric interface that is demountably sealing a full-face respirator to the hood. The figure is shown after the elastomeric interface engages the full-face respirator, that is, how the suit would look if the wearer had previously donned a full-face respirator and then the suit, and further inserted the full-face respirator through the opening in the elastomeric interface. In other words, how this protective garment would appear being worn with the separate full-face respirator.
Figure 7:
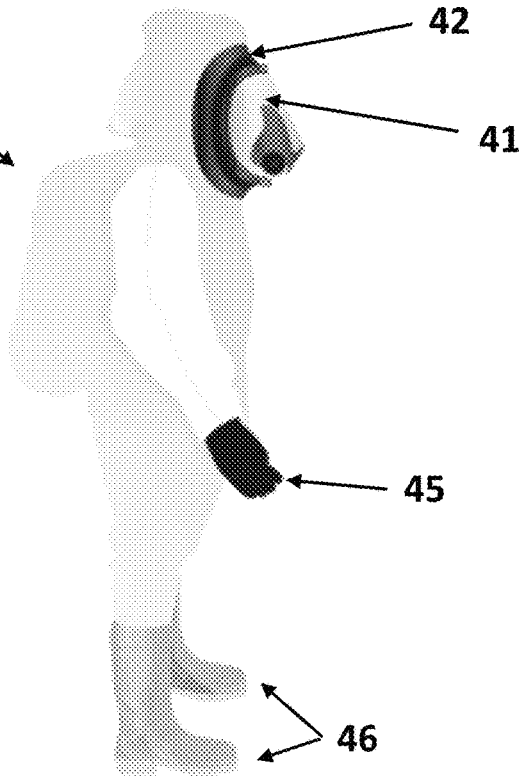

FIGS. 6 & 7 are illustrations of the front view and side view, respectively, of one type of protective garment, specifically an encapsulating full-body chemical-resistant suit 40, comprising a hood with a face area provided with an elastomeric interface that is demountably sealing a full-face respirator 41 to the hood. The elastomeric interface 42 is stretched around the facepiece of the full-face respirator 41. The figure is shown after the elastomeric interface engages the full-face respirator, that is, how the suit would look if the wearer had previously donned a full-face respirator and then the suit, and further inserted the full-face respirator through the opening in the elastomeric interface. In other words, how this protective garment would appear being worn with the separate full-face respirator. The suit is further shown with optional gloves 45 and boots 46.

Figure 8:
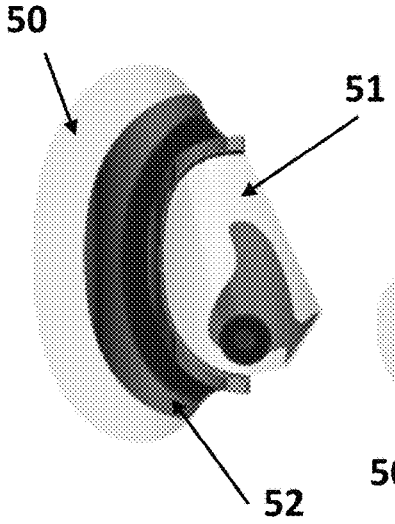
FIGS. 8, 9, & 10 are illustrations of a side view, top view, and bottom views, respectively, of the face area of the suit with the separate full-face respirator demountably sealed to the suit by the elastomeric interface. In other words, how the face area of the suit would appear while the separate full-face respirator was worn and engaged with the elastomeric interface.
Figure 9:
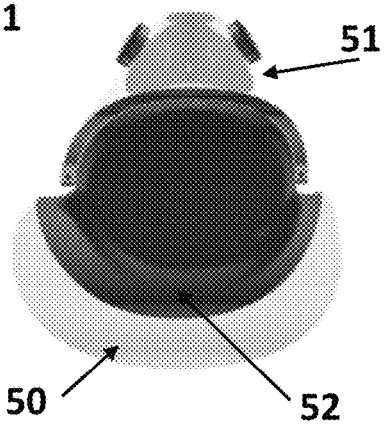
Figure 10:
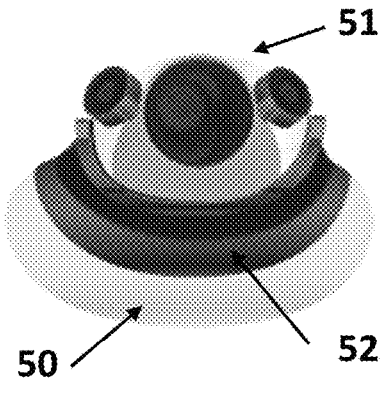

FIGS. 8, 9, & 10 are illustrations of a side view, top view, and bottom views, respectively, of the face area 50 of the suit with the separate full-face respirator 51 demountably sealed to the suit by the elastomeric interface 52. In other words, how the face area of the suit would appear while the separate full-face respirator was worn and engaged with the elastomeric interface.

As used herein, a full-face mask or full-face respirator is meant to include a mask worn on the head having a full-face lens or shield, or a mask worn on the head having a full-face lens or shield that additionally supports the respiration of the wearer, either from an internal or external source of air, with our without additional filtration.

Typically, a full-face mask or full-face respirator has a number of parts, including a clear, molded, full-face lens mounted in a housing that is further connected to a facepiece, and various clamps and straps for positioning the full-face mask or respirator on the head. The facepiece is the interface with the head and is generally made from tough polymeric material and has its own elastomeric material around the periphery to form a seal between the full-face mask or respirator and the front of the head of the wearer, typically the face of the wearer.

The protective garment is believed suitable for use with any full-face mask or respirator mask having a contact region around the periphery of the facepiece on which the elastomeric interface can conform to and can rest on to engage with the full-face mask or full-face respirator, when the opening in the elastomeric interface is stretched around the housing of the full-face mask or full-face respirator. Generally, the head straps of such full-face mask or full-face respirators are attached to the facepiece and not to the outer surface of the housing in which the full-face lens is mounted. Suitable commercially available full-face mask or full-face respirators that are useful with the protective garment include full-face mask models from Koken, Ltd; Scott models AV3000 and AV3000 Sure Seal; Draegar Models PPS 7000, FPS 7000, Futura, and P Nova; MSA models G1 Facepiece, Ultra Elite Facepiece, and Advantage 1000; Avon Deltair™ Compatible masks; and 3M 6800 series and FF400 series models.

By "engaging and demountably sealing a respirator to the hood", it is meant that when a wearer of a full-face respirator dons the garment, the elastomeric interface is stretched around the face-piece and seals the hood to the respirator by surface friction between the elastomeric interface and the contact region around the periphery of the facepiece, preferably overlapping the periphery of the face-piece in the contact region by 1 to 2 centimeters, thereby "engaging" the respirator. Further, the elastomeric interface is not permanently sealed to the respirator; the hood can be removed or "demounted" from the respirator without removing the respirator.

It is believed the elastomeric interface opening having a forehead edge, a chin edge, and two cheek edges as previously described and having the centerline horizontal dimension to centerline vertical dimension aspect ratio of 1.5 or greater provides a hooded garment that provides better sealing to a full-face mask or full-face respirator, allowing the wearer a larger range of motion with the head, while maintaining an adequate seal between the garment and the full-face mask or full-face respirator.

What is claimed is:

1. A protective garment comprising a hood with a face area, the face area provided with an elastomeric interface, the elastomeric interface having only a single opening for engaging and demountably sealing a full-face mask or full-face respirator to the hood, the opening having a forehead edge, a chin edge, and first and second cheek edges, the forehead edge and the chin edge being incurvate edges with respect to the center of the opening, and the two cheek edges being excurvate edges with respect to the center of the opening;

the opening further having a centerline horizontal dimension between the first and second cheek edges and a centerline vertical dimension between the forehead edge and the chin edge, the centerline horizontal dimension being longer than the centerline vertical dimension; the centerline horizontal dimension to centerline vertical dimension aspect ratio being 1.5 or greater.

2. The protective garment of claim 1 wherein the aspect ratio is 1.7 or greater.

3. The protective garment of claim 1 wherein the aspect ratio is 1.5 to 3.

4. The protective garment of claim 1 in the form of a hooded coverall.

5. The protective garment of claim 1 in the form of a jacket with a hood.

6. The protective garment of claim 1 in the form of a full-body chemical-resistant suit.

7. The protective garment of claim 1 wherein the chin edge is located at the bottom of the opening, and when engaged with the full-face respirator is positioned over the chin area of the wearer.

8. The protective garment of claim 1 wherein the full-face mask or full-face respirator includes a mask worn on the head having a full-face lens or shield, or a mask worn on the head having a full-face lens or shield that additionally supports the respiration of the wearer.

9. The protective garment of claim 1 wherein the elastomeric interface engages and demountably seals a full-face mask or full-face respirator to the hood by pulling the elastomeric interface over a mounting for a lens or a shield of the full-face mask or full-face respirator.

10. The protective garment of claim 1 wherein when the elastomeric interface engages and demountably seals a full-face mask or full-face respirator to the hood, the full-face mask or full-face respirator is inserted through the opening in the elastomeric interface and the opening in the elastomeric interface is stretched around the housing of the full-face mask or full-face respirator, the elastomeric interface conforming to and resting on a contact region around the periphery of the facepiece of the full-face mask or full-face respirator.

11. The protective garment of claim 10 in the form of a hooded coverall.

12. The protective garment of claim 10 in the form of a full-body chemical-resistant suit.

* * * * *